United States Patent [19]

Gersbeck

[11] 4,389,182

[45] Jun. 21, 1983

[54] CONTINUOUSLY OPERABLE CHIPBOARD PRESS

[75] Inventor: Rolf Gersbeck, Ronnenberg, Fed. Rep. of Germany

[73] Assignee: Hermann Berstorff Maschinenbau GmbH, Hanover, Fed. Rep. of Germany

[21] Appl. No.: 343,307

[22] Filed: Jan. 27, 1982

[30] Foreign Application Priority Data

Jan. 30, 1981 [DE] Fed. Rep. of Germany ..... 3103050

[51] Int. Cl.[3] ..... B28B 21/00

[52] U.S. Cl. ..... 425/505; 425/518

[58] Field of Search ..... 425/505, 518; 264/119, 264/120

[56] References Cited

U.S. PATENT DOCUMENTS 3,039,137 6/1962 Smith ..... 425/83.1

3,874,962 4/1975 Gersbeck et al. ..... 264/113

4,228,123 10/1980 Marshall ..... 264/119

4,349,325 9/1982 Mair ..... 264/120

*Primary Examiner*—James R. Hall

*Attorney, Agent, or Firm*—Schwartz, Jeffery, Schwaab, Mack, Blumenthal & Koch

[57] ABSTRACT

A continuously operable chipboard press has a heatable pressing drum enclosed over a part of its periphery by a first endless steel pressing belt which is guided around direction-changing rolls, thereby forming a pressing section for a chip cake. In order to increase the surface pressure applied by the endless pressing belt, a second endless steel pressing belt is guided around separate direction-changing rolls within a space between the pressing section and a return pass of the first endless pressing belt. The second endless steel pressing belt acts on the outer face of the first pressing belt for a part of the pressing section.

4 Claims, 1 Drawing Figure

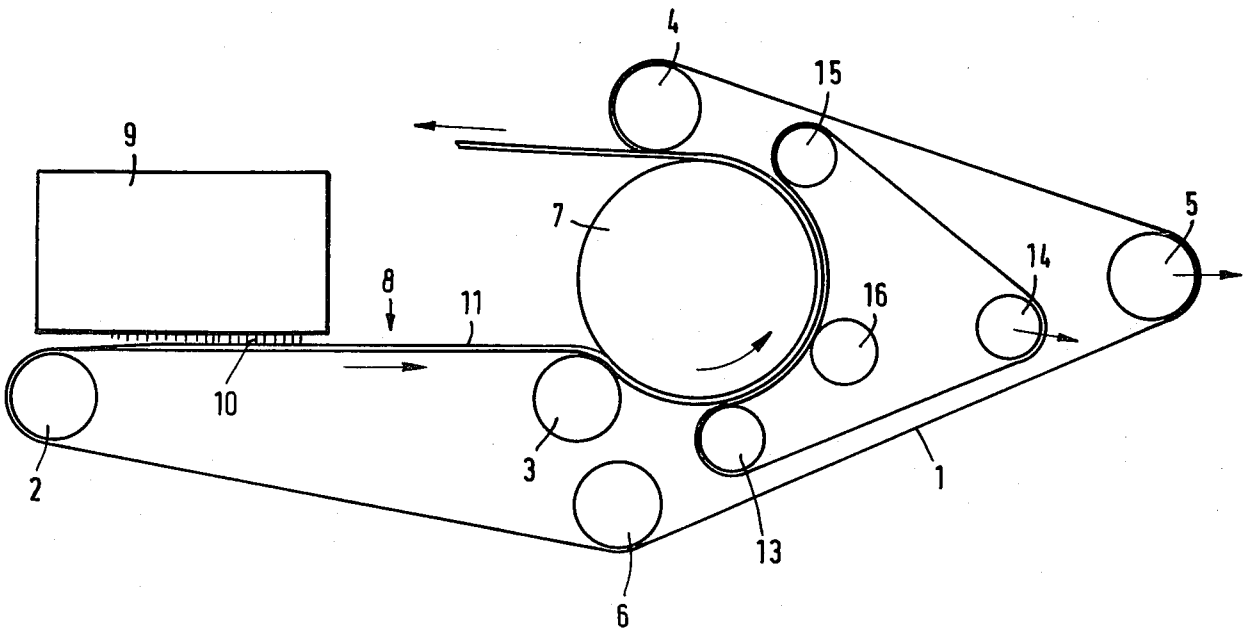
5
14
1
16
15
13
4
6
7
3
11
8
10
9
2

CONTINUOUSLY OPERABLE CHIPBOARD PRESS

The invention relates to a continuously operable chipboard press.

Continuously operable pressing apparatus for continuously producing chipboard webs is known from German Published Application No. 20 50 325 and comprises a pressing drum and an endless steel pressing belt which is disposed so as to enclose a part of the periphery of the pressing drum. Continuous pressing apparatus of this kind has been successful in practice and various modified forms thereof have been built.

In a continuously operating chipboard press, it is known from German Published Application No. 20 34 853 for pressure rolls to be disposed to act on the outer face of the part of the endless steel belt which extends partly around the pressing drum. The pressure rolls serve substantially to increase the pressing pressure applied to the pressing drum, which cannot be done solely by the steel pressing belt, by virtue of the maximum admissible tension in the steel pressing belt. A high pressing pressure is desirable in order to cause compacting of the mixture of wood chips and adhesive and thus to produce a finished chipboard with a dense structure. This increases the mechanical load carrying capability of the finished chipboard.

However, the pressure rolls only apply a line pressure. After having passed a pressure roll, the mixture of wood chips and adhesive to be pressed springs back to a greater thickness than the magnitude of the pressure roll gap. The reason for this resilient increase in the thickness of the mixture of wood chips lies in the creation of vapour pressure in the chip structure during the pressing and hardening operation which takes place under heated conditions. After the material leaves the pressure roll gap, the vapour expands, forces the chip structure apart and seeks to escape to the atmosphere.

In this respect, the insufficient counter-acting pressure can result in the formation of bubbles, cracks and gaps in the chipboard, so that there is no guarantee in respect of internal coherence in the chipboard. In such cases, the product quality is poor and the chipboard is useless for many purposes.

It has therefore already been proposed in German Patent Specification No. 25 49 560 that the endless steel pressing belt which is passed around a pressing drum may be acted upon by a pressure shell member which applies a surface pressure. The pressure shell member is disposed on the outer face of the steel pressing belt, in the region in which it passes around the pressing drum. A pressure shell member which can be acted upon by a pressure medium is disposed downstream of each pressure roll. This arrangement thus provides for advantageous co-operation between the line pressure of a pressure roll and the subsequent surface pressure of a pressure shell member, in addition to the pressing pressure of the steel pressure belt, and makes it possible for the chip cake initially to be compact with a high line pressure and for the pressure then still required to be maintained by means of the pressure shell members, such maintained pressure preventing the chips from resilient expansion under the effect of the vapour pressure therein, thereby ensuring internal cohesion between the chips while the adhesive which acts as a bonding agent hardens.

It will be appreciated that providing a pneumatically or hydraulically actuable pressure shell member requires a high level of expenditure on sealing means, which makes maintenance and operation of a continuous pressing apparatus more difficult.

The invention is based on the problem of so designing a continuously operating chipboard press of the kind referred to that additional surface pressure can be applied without a high level of technical expenditure.

According to the invention, there is provided a continuously operable chipboard press comprising a heatable pressing drum; a first endless steel pressing belt; and a plurality of direction-changing rolls around which said first belt passes and which cause one face of said first belt to be pressed against the outer surface of said drum over a part of the periphery of said drum thereby forming a pressing section for pressing a chip cake of wood chips and adhesive fed between said first belt and said drum; wherein at least one of said direction-changing rolls also acts as a pressure roll by bearing against the opposite face of said first belt to said one face within said pressing section; and wherein the press further comprises a second endless steel pressing belt and further direction-changing rolls around which said second belt passes within a space defined between said pressing section and a return pass of said first belt, said second belt pressing against said opposite face of said second belt for a part of said pressing section.

The second endless pressing belt which is guided within the space circumscribed by the first endless steel pressing belt, passes around separate direction-changing rolls. The two pressing belts lie one upon the other only in the region in which they pass around the pressing drum. That is not the case in the region in which they pass around their respective direction-changing rolls. By virtue of the pressing drum having two steel pressing belts extending partly around the drum, the pressure on the chipboard web to be pressed can be twice as high, in the area in which the pressing drum has both pressing belts extending therearound, compared with locations at which only the first steel pressing belt passes around the pressing drum.

Therefore, after the chip cake has been highly compacted by the first pressure roll, a surface pressure which is required for hardening of the chipboard web can be maintained over a sufficiently long pressing section, by means of the second steel pressing belt.

The invention is diagrammatically illustrated by way of example in the accompanying drawing which is a schematic side view of a continuously operable chipboard press according to the invention.

Referring to the drawing, an endless steel pressing belt 1 is guided around direction-changing rolls 2 to 6 and a heatable and rotatable pressing drum 7. The endless steel pressing belt 1 passes around the pressing drum 7 with one of its faces pressed against a portion of the periphery of the drum which portion defines a pressing section. The direction-changing roll 3 serves also as a pressure roll pressing the belt 1 against the pressing drum 7. The steel pressing belt 1 is moved with a circulatory motion by one or more of the direction-changing rolls 2 to 6 being driven. The direction-changing roll 5 serves also as a tensioning roll for the belt 1.

The direction-changing roll 2 is disposed upstream of the pressing drum 7, and, with the roll 3, forms a horizontal portion 8 of the belt 1 onto which wood chips can be sprinkled. A sprinkling device 9 for sprinkling a mixture 10 of wood chips and adhesive is disposed above the horizontal portion 8 to form a chip cake to be pressed which is carried towards the drum on a portion of the belt indicated at 11.

In the region in which the pressing belt 1 extends around the pressing drum 7, the opposite face to said one face of the pressing belt 1 is acted upon by a second steel pressing belt 12. The second endless pressing belt 12 is disposed in a space circumscribed by the portion of the first pressing belt 1 which defines the pressing section and a return pass of the first belt 1 which extends around the rolls 4, 5 and 6. The second belt 12 is guided around separate direction-changing rolls 13 to 15. The direction-changing roll 14 also acts as a tensioning roll for the second belt 12. A pressure roll 16 acts on the face of the second belt 12 remote from the belt 1 in the region in which it passes around the pressing drum 7, and applies a pressure to the two superposed steel pressing belts 1 and 12, towards the pressing drum 7.

Wood chips 10 are sprinkled or strewed onto the moving steel pressing belt 1. At the pressure roll 3, the chip cake on the portion 11 of the belt is engaged by the pressing drum 7 and passes into the pressing section between the pressing drum 7 and the first pressing belt 1, being the section in which it is first heavily compacted as it passes the roll 3. The material to be pressed then passes through a region in which there is a high surface pressure and in which the pressed chip cake is caused to harden by heat from the heated drum 7. This high surface pressure region is represented by the region in which the second steel pressing belt 12 passes around the pressing drum. The second pressing belt 12 is subjected to a tensional force, by means of the tensioning roll 14, and presses against the back of the first endless steel pressing belt 1.

By the time it leaves the high surface pressure region, the bonding agent of the wood chip mixture will have almost completely hardened. In the following region at a lower pressure which is applied only by the first steel pressing belt 1, no cracking or splitting or resilient expansion movement of the pressed structure can occur. The finished pressed chipboard can be removed at the direction-changing roll 4.

It is possible for the chipboard press according to the invention also to be used for facing chipboard with plastics films.

What is claimed is:

1. A continuously operable chipboard press comprising:

(a) a heated press drum, and means for heating the same;

(b) a first endless steel belt adapted to be pressed on one face thereof against the inner surface of said drum in a pressing section around said drum;

(c) a plurality of direction-changing rolls around which said first belt passes, and means for tensioning said first belt around said drum in said pressing section, certain of said rolls being arranged substantially horizontal so as to permit said first belt to receive, in advance of said drum, a chip cake of wood chips and adhesive to be formed into such chipboard;

(d) at least one of said direction-changing rolls bearing against the opposite face of said first belt and serving as a pressure roll;

(e) a second endless steel pressing belt overlying said first belt in the pressing section; and (f) an additional set of direction-changing rolls around which said second belt passes and is tensioned, at least certain of said additional rolls pressing said second belt against the opposite face of said first belt over the entire or part of said pressing section, whereby the high pressure in said pressing section results in a cured and hardened wood chip mixture.

2. The apparatus of claim 1 wherein said pressure roll is positioned where said first belt on its forward pass engages said drum, said pressure roll being in advance of the pressing section and providing first heavy compacting of said chip cake.

3. The apparatus of claim 2 wherein said pressure roll is one of said substantially horizontally arranged rolls.

4. The apparatus of claim 1, further including a second pressure roll acting on the outer face of said second belt in said pressing section, thereby applying additional pressure on said belts in the direction of said drum in said pressing section.

* * * * *